US005897299A

United States Patent [19]

Fukunaga

[11] Patent Number: 5,897,299

[45] Date of Patent: Apr. 27, 1999

[54] ANTI-REVERSE ROTATION APPARATUS OF COMPRESSOR

[75] Inventor: Tsuyoshi Fukunaga, Osaka, Japan

[73] Assignee: Daikin Industries, Ltd., Osaka, Japan

[21] Appl. No.: 08/776,016

[22] PCT Filed: May 23, 1996

[86] PCT No.: PCT/JP96/01410

§ 371 Date: Jan. 17, 1997

§ 102(e) Date: Jan. 17, 1997

[87] PCT Pub. No.: WO96/37707

PCT Pub. Date: Nov. 28, 1996

[30] Foreign Application Priority Data

May 23, 1995 [JP] Japan ..... 7-123463

[51] Int. Cl.[6] ..... F04B 35/04

[52] U.S. Cl. ..... 417/316; 417/44.1; 417/310; 417/423.12; 417/440

[58] Field of Search ..... 417/44.1, 310, 417/316, 423.12, 424.1, 440; 415/56.2, 56.5, 58.4

[56] References Cited

U.S. PATENT DOCUMENTS

| | | | |
|---|---|---|---|
| 3,406,897 | 10/1968 | Diels | 417/316 |
| 4,627,788 | 12/1986 | Keyes, IV. et al. . | |
| 4,697,980 | 10/1987 | Keyes, IV. et al. . | |
| 4,764,085 | 8/1988 | Jesinger . | |
| 5,607,288 | 3/1997 | Wallis et al. | 417/310 |

FOREIGN PATENT DOCUMENTS

| | | | |
|---|---|---|---|
| 114329 | 9/1929 | Austria | 415/56.5 |
| 237681 | 8/1945 | France . | |
| 2 592 688 | 1/1986 | France . | |
| 3600124 A1 | 1/1986 | Germany . | |
| 54-153910 | 12/1979 | Japan . | |
| 5-340386 | 12/1983 | Japan . | |
| 438919 | 6/1992 | Japan . | |
| 6-346896 | 12/1994 | Japan . | |

OTHER PUBLICATIONS

"Constraints Complicate Centrifugal Compressor Depressurization" Oil & Gas Jornal, XP–002068741, vol. 91, No. 19, May 10, 1993, pp. 50–54.

*Primary Examiner*—Charles G. Freay
*Attorney, Agent, or Firm*—Sixbey, Friedman, Leedom & Ferguson, P.C.; Gerald J. Ferguson, Jr.

[57] ABSTRACT

An inlet pipe (7) and a discharge pipe (9) of a centrifugal compressor (1) are provided with respective solenoid valves (16, 17) for allowing a flow of fluid in a direction of flow under operation of fluid compression. One end of a bypass pipe (20) is connected to a part of the inlet pipe (7) located between the solenoid valve (16) and an impeller room (6). The other end of the bypass pipe (20) is connected to a part of the discharge pipe (9) located between the impeller room (6) and the solenoid valve (17). The bypass pipe (20) is provided with a solenoid valve (21) which closes under operation of fluid compression of the centrifugal compressor (1) while opening under deactivating operation of the centrifugal compressor (1).

7 Claims, 6 Drawing Sheets

ANTI-REVERSE ROTATION APPARATUS OF COMPRESSOR

TECHNICAL FIELD

This invention relates to an anti-reverse rotation apparatus of a compressor and relates to, for example, measures for avoiding an impeller of a centrifugal compressor from rotating in reverse due to high pressure working from a discharge side of the compressor when the centrifugal compressor is deactivated.

BACKGROUND ART

As a compressor used in a refrigerating circuit of an air conditioner, there is known a conventional centrifugal compressor as disclosed in Japanese Patent Application Laid-Open Gazette No. 5-340386.

The above conventional centrifugal compressor will be schematically described below. As shown in FIG. 6, in a casing (a), a motor room (b) and an impeller room (c) are formed. The motor room (b) contains a motor (d) and the impeller room (c) contains an impeller (rotary vanes) (f) directly connected to a driving shaft (e) of the motor (d). Further, the casing (a) is connected to an inlet pipe (g) as opposed to a center portion of the impeller (f) and is connected to a discharge pipe (h) as opposed to an outer peripheral portion of the impeller (f).

When the motor (d) is operated to rotate the impeller (f), a fluid is sucked into the impeller room (c) through the inlet pipe (g), is subjected to centrifugal force into a radially outward flow, is compressed, and is then discharged through the discharge pipe (h).

Upper and lower ends of the driving shaft (e) are inserted into respective through holes (i1, i1) of bearing plates (i, i) fixed on the inner surface of the casing (a). Further, the outer periphery of the driving shaft (e) has herringbone grooves (e1, e1) formed at respective positions opposed to the inner peripheries of the through holes (i1, i1). The herringbone grooves (e1, e1) forms dynamic pressure gas bearings between the driving shaft (e) and the bearing plates (i, i).

In detail, the rotation of the driving shaft (e) produces respective gas layers due to gas pressure between the driving shaft (e) and the inner peripheries of the through holes (i1, i1) so that the driving shaft (e) is rotatably supported by the gas layers in non-contact with the bearing plates (i, i).

The dynamic pressure gas bearing of this kind produces a gas layer only by a rotation of the driving shaft (e) in a single direction to rotatably support the driving shaft (e). Therefore, the dynamic pressure gas bearing functions as a bearing only when the driving shaft (e) rotates in a rotational direction of the impeller (f) under operation of fluid compression of the compressor.

Problems to be Solved

In such a centrifugal compressor, during running operation, the inside of the inlet pipe (g) is put into a low pressure state under reduced pressure due to fluid suction, whereas the inside of the discharge pipe (h) is put into a high pressure state due to a compressed fluid.

Hence, at the time when the rotation of the impeller (f) is stopped by a deactivating operation of the centrifugal compressor, the inside of the discharge pipe (h) located downstream from the impeller (f) becomes higher in pressure than the inside of the inlet pipe (g) upstream from the impeller (f). This higher pressure acts on the inlet pipe (g) through the impeller room (c). As a result, the higher pressure may rotate the impeller (f) opposite to the rotational direction of the impeller (f) under operation of fluid compression.

In such a condition, the driving shaft (e) also rotates in reverse. When the driving shaft (e) rotates in reverse, the bearing functions of the dynamic pressure gas bearings cannot be performed and in some instances, the driving shaft (e) may seize up on the bearing plates (i, i).

In view of the foregoing problems, the present invention has been made and has its object of preventing respective reverse rotations of a rotor and a driving shaft of a compressor by preventing the action of a high pressure on the rotor from a discharge side of the compressor when the compressor is deactivated.

DISCLOSURE OF INVENTION

Summary of the Invention

In the present invention, when a compressor is deactivated, a pressure difference between upstream and downstream from a rotor is reduced. Thereby, a pressure in the reverse direction of rotation does not act on the rotor.

Features of the Invention

More specifically, one feature of the invention includes a compressor in which a suction passage (7) and a discharge passage (9) are connected to a room (4) where a rotor (6) is housed, the rotor (6) is connected to a driving shaft (11) of driving means (10), and the compressor sucks a fluid into the room (4) through the suction passage (7) by rotation of the rotor (6), compresses the sucked fluid and then discharges the compressed fluid through the discharge passage (9).

In the above structure, a bypass passage (20) which bypasses the room (4) and connects between the suction passage (7) and the discharge passage (9) is provided.

Further, the bypass passage (20) is provided with a shut-off valve (21) for closing the bypass passage (20) under operation of fluid compression during which the rotor (6) is rotated, while opening the bypass passage (20), in a deactivating motion of the rotor (6) from a rotating state to a stopping state, to eliminate a pressure difference between the suction passage (7) and the discharge passage (9).

Furthermore, in the structure, a dynamic pressure gas bearing (18) which produces a gas layer around the driving shaft (11) only during rotation of the driving shaft (11) in a single direction for fluid compression to rotatably support the driving shaft (11) is provided.

A further feature of the invention is such that in the above discussed structure of the invention, the suction passage (7) is provided with a suction side non-return valve (16) for allowing the fluid to flow only into the room (4) and the discharge passage (9) is provided with a discharge side non-return valve (17) for allowing the fluid to discharge only from the room (4).

Further, in the structure, one end of the bypass passage (20) is connected somewhere between the suction side non-return valve (16) and the room (4) in the suction passage (7) and the other end thereof is connected somewhere between the room (4) and the discharge side non-return valve (17) in the discharge passage (9).

Another feature of the invention is such that in the above structures of the invention, the compressor (1) is a centrifugal compressor whose rotor is formed of an impeller (6) for sucking the fluid from the suction passage (7) in an axial direction, producing a radially outward flow of the fluid and releasing the fluid outward for compression.

A further feature of the invention includes a compressor in which a suction passage (7) and a discharge passage (9) are connected to a room (4) where a rotor (6) is housed, the rotor (6) is connected to a driving shaft (11) of driving means (10), and the compressor sucks a fluid in an axial direction through the suction passage (7) by rotation of the rotor (6), produces a radially outward flow of the fluid, compresses the fluid and discharges the fluid through the discharge passage (9).

Further, the driving shaft (11) is rotatably supported to a dynamic pressure gas bearing (18) which produces a gas layer around the driving shaft (11) only during rotation of the driving shaft (11) in a single direction for fluid compression.

Furthermore, in the structure, deactivation control means (25) is provided for controlling the rotor (6), prior to stop of the rotor (6) in a deactivating motion of the rotor (6) from a rotating state to a stopping state, at a specific low rotational speed near 0 in the normal direction of rotation and holding the rotor (6) at the low rotational speed until a set time passes.

Another feature of the invention comprises, in addition to the structure of claim 4 of the invention, a bypass passage (20) which bypasses the room (4) and connects between the suction passage (7) and the discharge passage (9).

Further, the bypass passage (20) is provided with a shut-off valve (21) for closing the bypass passage (20) under operation of fluid compression in which the rotor (6) is rotated, while opening the bypass passage (20), in a deactivating motion of the rotor (6) from a rotating state to a stopping state, to eliminate a pressure difference between the suction passage (7) and the discharge passage (9).

A further feature of the invention is such that the deactivation control means (25) gradually reduces the number of rotations of the rotor (6) to the specific low rotational speed near 0 in the normal direction of rotation, holds the rotor (6) at the low rotational speed until the set time passes, and thereafter brings the rotor (6) to a stop.

Another feature of the invention is such that the suction passage (7) is provided with a suction side non-return valve (16) for allowing the fluid to flow only into the room (4) and the discharge passage (9) is provided with a discharge side non-return valve (17) for allowing the fluid to discharge only from the room (4).

Further, in the structure, one end of the bypass passage (20) is connected somewhere between the suction side non-return valve (16) and the room (4) in the suction passage (7) and the other end thereof is connected somewhere between the room (4) and the discharge side non-return valve (17) in the discharge passage (9).

Operations

The above-mentioned features of the present invention perform the following operations.

First, under operation of fluid compression, the rotor (6) rotates in the room (4) by rotation of the driving shaft (11). Through the rotation of the rotor (6), a fluid is sucked into the room (4) through the suction passage (7), is compressed in the room (4) and is discharged to the discharge passage (9).

Under the above operation of fluid compression, the dynamic pressure gas bearing (18) produces a gas layer around the driving shaft (11) only during rotation of the driving shaft (11) in a single direction thereby supporting the driving shaft (11).

Further, under the operation of fluid compression, the bypass passage (20) is closed by the shut-off valve (21) so that a specific pressure difference occurs between the suction passage (7) and the discharge passage (9) thereby compressing the fluid.

On the other hand, in a deactivating motion of the rotor (6) from a rotating state to a stopping state, the shut-off valve (21) opens so that the bypass passage (20) is opened. The opening of the bypass passage (20) causes a high pressure in the discharge passage (9) to act on the suction passage (7) through the bypass passage (20), so that the pressure difference between the suction passage (7) and the discharge passage (9) is eliminated. Accordingly, the high pressure in the discharge passage (9) does not act on the rotor (6) thereby preventing the rotor (6) from rotating in reverse.

When the bypass passage (20) is opened by the shut-off valve (21) in a deactivating motion of the rotor (6) from a rotating state to a stopping state, a high pressure in a part of the discharge passage (9) between the room (4) and the discharge side non-return valve (17) acts on a part of the suction passage (7) between the suction side non-return valve (16) and the room (4). Thereby, the fluid space between both the non-return valves (16, 17) is equalized in pressure.

When the centrifugal compressor (1) is deactivated, the impeller (6) is prevented from rotating in reverse. Thereby, the centrifugal compressor (1) obtain high reliability.

Prior to stop of the rotor (6) of the centrifugal compressor in a deactivating motion of the rotor (6) from a rotating state to a stopping state, the deactivation control means (25) controls the rotor (6) at a specific low rotational speed near 0 in the normal direction of rotation and holds the rotor (6) at the low rotational speed until a set time passes. In detail, the centrifugal compressor changes a pressure difference between the suction passage (7) and the discharge passage (9) in dependence on the number of rotations of the rotor (6). Therefore, when the rotor (6) is held at a low rotational speed in the normal direction of rotation as mentioned above, the pressure difference between the suction passage (7) and the discharge passage (9) is reduced. Accordingly, when the rotor (6) comes to a stop from the low rotational speed state, the rotor (6) does not rotate in reverse because of the above-mentioned reduced pressure difference.

In a deactivating motion of the rotor (6), the rotor (6) is held at a low rotational speed in the normal direction of rotation, and at the same time the bypass passage (20) is opened by the shut-off valve (21). As a result, a pressure difference between the suction passage (7) and the discharge passage (9) is more securely eliminated thereby securely preventing a reverse rotation of the rotor (6).

In the deactivating motion of the rotor (6), the number of rotations of the rotor (6) is first gradually reduced. Thereafter, the rotor (6) is controlled at the specific low rotational speed near 0 in the normal direction of rotation, is held at the low rotational speed until the set time passes, and is then brought into a stop. Through such a series of operations, a pressure difference between the suction passage (7) and the discharge passage (9) is securely minimized.

When the bypass passage (20) is opened by the shut-off valve (21), a high pressure in a part of the discharge passage (9) between the room (4) and the discharge side non-return valve (17) acts on a part of the suction passage (7) between the suction side non-return valve (16) and the room (4).

Effects of the Invention

Since the suction passage (7) is communicated with the discharge passage (9) through the bypass passage (20) in deactivating the compressor thereby eliminating a pressure difference between the suction passage (7) and the discharge passage (9), it can be securely prevented that a high pressure in the discharge passage (9) acts on the rotor (6) to rotate the rotor (6) in reverse. Thereby, inconveniences due to reverse rotation of the rotor (6) can be securely avoided.

In particular, in the structure that the driving shaft (11) is supported by the dynamic pressure gas bearing (18), it can be avoided that the bearing function of the dynamic pressure gas bearing (18) is not displayed due to reverse rotation of the rotor (6). Thereby, the driving shaft (11) can be securely prevented from seizing up.

A region in which a pressure difference between the suction passage (7) and the discharge passage (9) is eliminated by means of the bypass passage (20) can be defined to a region between both the non-return valves (16, 17) provided in the suction passage (7) and the discharge passage (9) respectively. As a result, a high pressure can be prevented from being introduced into a part of the suction passage (7) located upstream from the suction side non-return valve (16), and a part of the discharge passage (9) located downstream from the discharge side non-return valve (17) can be prevented from being under a low pressure. Accordingly, a pressure difference between the upstream and downstream sides of the rotor (6) can be eliminated thereby preventing reverse rotation of the rotor (6), without affecting other units connected to the suction passage (7) and the discharge passage (9).

Since the above-mentioned structures are applied to a centrifugal compressor (1), the turbo compressor (1) can obtain high reliability.

Since the rotor (6) is controlled at a specific low rotational speed near 0 in the normal direction of rotation prior to stop of the rotor (6) of the centrifugal compressor (1) in a deactivating motion of the rotor (6), a pressure difference between the suction passage (7) and the discharge passage (9) can be minimized when the rotor (6) comes into a stop. This prevents an occurrence of reverse rotation of the rotor (6). In particular, an occurrence of reverse rotation of the rotor (6) can be prevented through the operation control of the rotor (6) alone, without improving the entire structure of the compressor.

In a deactivating motion of the rotor (6) of the centrifugal compressor (1), the rotor (6) is controlled at a low rotational speed in the normal direction of rotation and at the same time the suction passage (7) is communicated with the discharge passage (9) through the bypass passage (20). Thereby, a pressure difference between the suction passage (7) and the discharge passage (9) can be more securely eliminated when the rotor (6) comes into a stop.

For example, when the driving means (10) is inverter-controlled to a low rotational speed state, a slight pressure difference remains between the suction passage (7) and the discharge passage (9). In such a case, the pressure difference can be securely eliminated by means of the bypass passage (20), thereby securely preventing reverse rotation of the rotor (6).

Further, in the case of inverter control of the driving means (10), when a power failure occurs under operation of fluid compression, the function of preventing reverse rotation by the deactivation control means (25) does not work. However, since this structure of the invention includes the bypass passage (20) and the shut-off valve (21), it can eliminate the pressure difference through the bypass passage (20). Accordingly, reverse rotation of the rotor (6) can be prevented even when a power failure occurs.

In a deactivating motion of the rotor (6), the rotor (6) is first gradually reduced in number of rotations, is controlled at a specific low rotational speed near 0 in the normal direction of rotation, is held at the low rotational speed for a set time, and is then brought into a stop. Accordingly, a pressure difference between the suction passage (7) and the discharge passage (9) can be securely minimized, thereby securely preventing reverse rotation of the rotor (6).

A region in which a pressure difference is reduced can be defined to a region between both the non-return valves (16, 17) provided in the suction passage (7) and the discharge passage (9) respectively. Thereby, a high pressure can be prevented from being introduced into a part of the suction passage (7) located upstream from the suction side non-return valve (16), and a part of the discharge passage (9) located downstream from the discharge side non-return valve (17) can be prevented from being under a low pressure. Accordingly, other units connected to the suction passage (7) and the discharge passage (9) can be prevented from being affected.

BEST MODE FOR CARRYING OUT THE INVENTION

Below, description is made about embodiments of the present invention with reference to the drawings. The following embodiments are applications to a centrifugal compressor.

First Embodiment

The present embodiment is directed to improve the piping structure for suction and discharge of a fluid in a centrifugal compressor, thereby preventing reverse rotation of the compressor when the compressor is deactivated.

Figure 1:
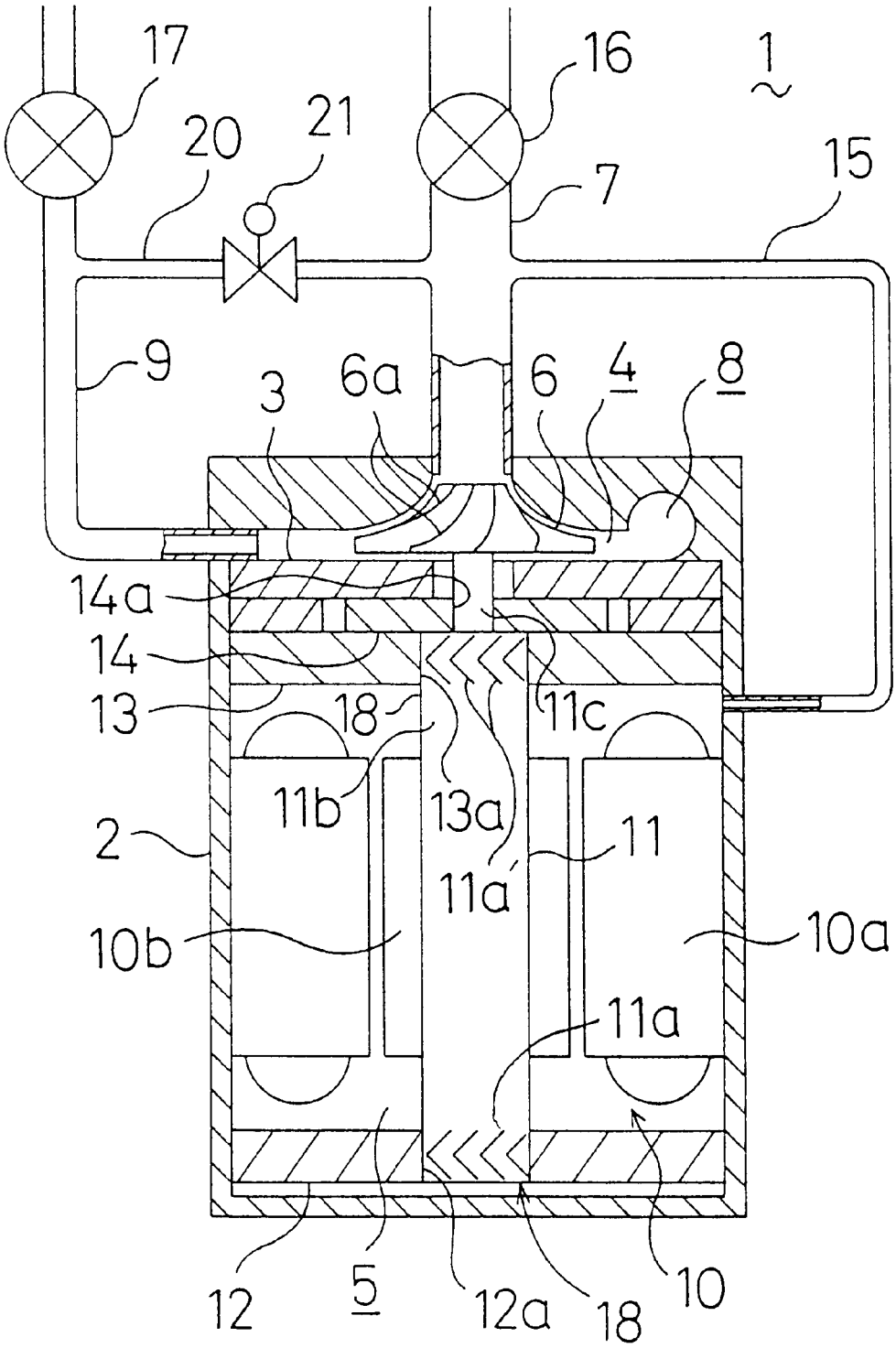
FIG. 1 is a cross-sectional view of a centrifugal compressor according to a first embodiment of the present invention.

FIG. 1 is a cross-sectional view showing the interior structure of a centrifugal compressor (1) according to the present embodiment. As shown in the figure, in a casing (2), a partition wall (3) is disposed at a specific distance downwardly away from the upper end of the casing (2) so that the inner space of the casing (2) is partitioned into an impeller room (4) on the upper side and a motor room (5) on the lower side.

The impeller room (4) is formed at the center of the casing (2) in a top view to form a room for housing an impeller (6). The shape of the impeller room (4) is substantially a truncated cone that the inner diameter of the room gradually increases downward. The impeller room (4) houses the impeller (6) so as to allow its rotation. The impeller (6) is composed of a plurality of substantially angular vanes (6*a*, 6*a*, . . . ) arranged radially around a vertical axis to form a radial rotor for producing a radially outward flow of a fluid.

The casing (2) is connected at the center of the top surface to an inlet pipe (7). The inlet pipe (7) forms a suction passage for sucking a fluid from above the impeller (6) along the axis of the impeller (6) and introducing the fluid into the impeller room (4).

On the outer periphery of the impeller (6) in the impeller room (4), a compression space (8) is formed for recovering a dynamic pressure from a released fluid obtaining the dynamic pressure and a static pressure under centrifugal force applied by the impeller (6).

The casing (2) is connected, at a position on the side surface corresponding to the compression space (8), to a discharge pipe (9). The discharge pipe (9) forms a discharge passage for discharging a fluid released into the compression space (8) to the outside of the casing (2). In short, the impeller room (4) orients a fluid sucking through the inlet pipe (7) in association with rotation of the impeller (6) into a radially outward flow and discharges the fluid from the compression space (8) to the discharge pipe (9).

On the other hand, the motor room (5) houses a motor (10) for driving the impeller (6) into rotation. The motor (10) forms a driving means which includes a stator (10*a*) fixed on the inner wall of the motor room (5) and a rotor (10*b*) contained in the stator (10*a*) in a coaxial arrangement to the impeller (4). The rotor (10*b*) is provided at a center thereof with a driving shaft (11) joining to the center of the bottom of the impeller (6). The driving shaft (11) is rotatably supported at upper and lower ends thereof to the casing (2) through respective bearing plates (12, 13).

Specifically, the lower end of the driving shaft (11) extends downward under the lower end of the rotor (10*b*) and passes through a through hole (12*a*) of the lower bearing plate (12) disposed at a lower end portion of the motor room (5).

Figure 2:
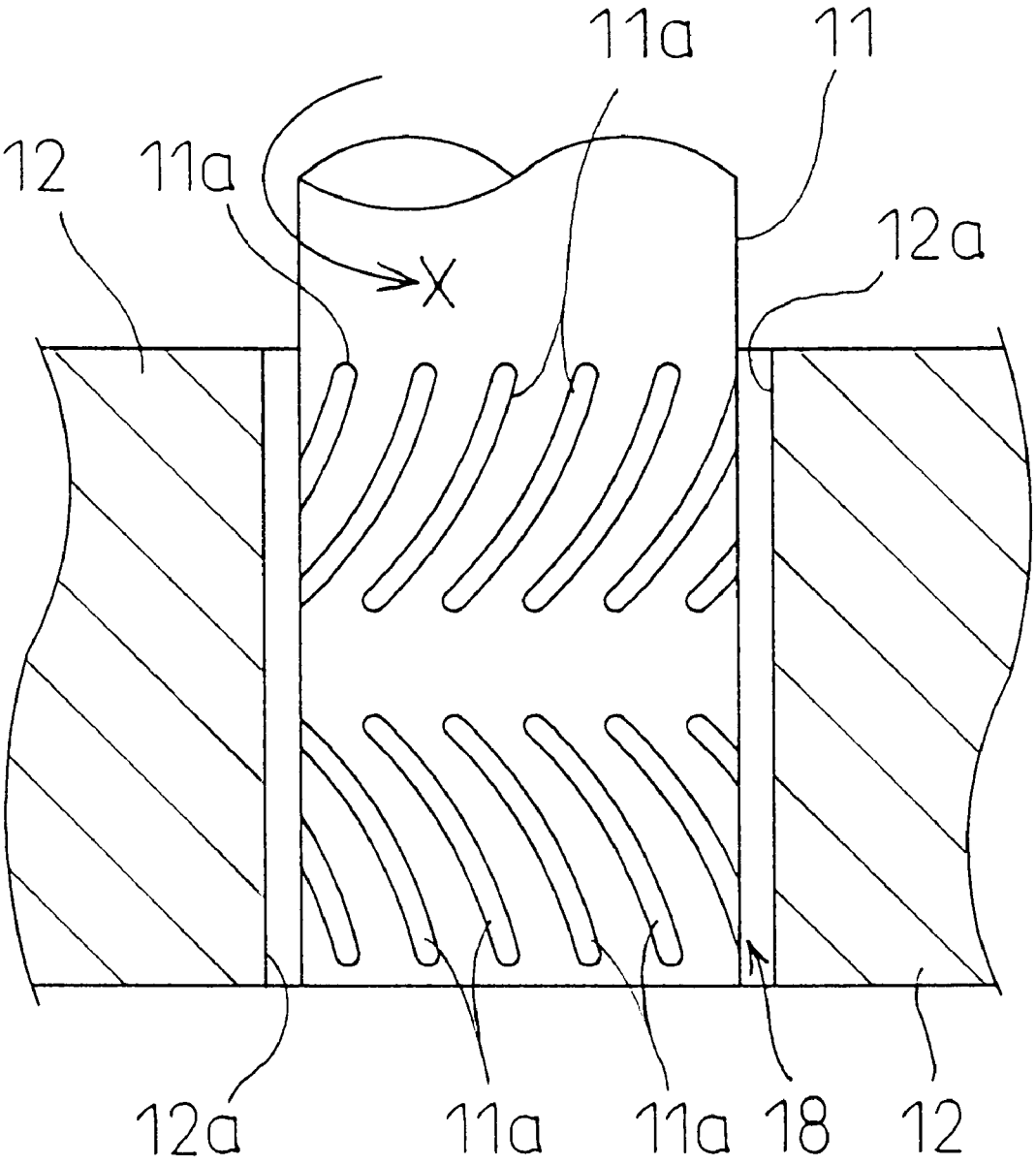
FIG. 2 is a cross-sectional view showing a main part of a dynamic pressure gas bearing.

As one feature of the present invention, a plurality of herringbone grooves (11*a*, 11*a*, . . . ) are formed on the outer periphery of the lower end of the driving shaft (11). In detail, as shown in FIG. 2, two horizontal rows of herringbone grooves (11*a*, 11*a*, . . . ) are formed in a vertical arrangement at the lower end of the driving shaft (11). The herringbone grooves (11*a*, 11*a*, . . . ) each have the form of gradually twisting against a rotational direction of X from its inside end toward its outside end.

When the driving shaft (11) rotates, the herringbone grooves (11*a*, 11*a*, . . . ) produce a gas layer due to a gas pressure in a clearance between the outer periphery of the driving shaft (11) and the inner periphery of the through hole (12*a*). The gas layer forms a dynamic pressure gas bearing (18) which supports the lower end of the driving shaft (11) in a non-contact state. In other words, the dynamic pressure gas bearing (18) is commonly known as a herringbone journal gas bearing and rotatably supports the lower end of the driving shaft (11).

The upper end of the driving shaft (11) extends upward over the upper end of the rotor (10*b*). The driving shaft (11) is composed of a large-diameter part (11*b*) located on the lower side and a small-diameter part (11*c*) upwardly contiguous to the large-diameter part (11*b*) and connected to the impeller (6). The upper end of the large-diameter part (11*b*) is inserted into a through hole (13*a*) of the upper bearing plate (13) disposed at an upper portion of the motor room (5).

The large-diameter part (11*b*) is rotatably supported by a dynamic pressure gas bearing (18) similar to the above-mentioned bearing structure at the lower end of the driving shaft (11). In detail, a plurality of herringbone grooves (11*a*', 11*a*', . . . ) are formed on the outer periphery of the large-diameter part (11*b*) to produce a gas layer in a clearance between the outer periphery of the driving shaft (11) and the inner periphery of the through hole (13*a*) during rotation of the driving shaft (11). The gas layer forms the above-mentioned dynamic pressure gas bearing (18) which supports the upper end of the driving shaft (11) in a non-contact state.

A thrust bearing plate (14) is placed over the upper bearing plate (13). A through hole (14*a*) approximately identical in diameter to the small-diameter part (11*c*) of the driving shaft (11) is formed at the center of the thrust bearing plate (14). The inner surface of the through hole (14*a*) is joined to the outer periphery of the small-diameter part (11*c*) so that the driving shaft (11) and the thrust bearing plate (14) are fixedly connected into one piece.

The bottom surface of the thrust bearing plate (14) is opposed to the top surface of the upper bearing plate (13) while the top surface of the thrust bearing plate (14) is opposed to the bottom surface of the partition wall (3). Both the top and bottom surfaces of the thrust bearing plate (14) have respective spiral grooves in substantially spiral form, though they are not shown. These spiral grooves form dynamic pressure gas bearings serving as upward and downward thrust bearings between the partition wall (3) and the thrust bearing plate (14) and between the thrust bearing plate (14) and the upper bearing plate (13), respectively. Thus, these dynamic pressure gas bearings support the driving shaft (11) in a direction of thrust.

The inlet pipe (7) is connected to the motor room (5) through a pressure equalizing pipe (15). Specifically, an internal pressure of the inlet pipe (7) changes according to the number of rotations of the impeller (6). The pressure equalizing pipe (15) returns, to the inlet pipe (7), a leakage fluid entering the motor room (5) from the impeller room (4).

As another feature of the present invention, a first solenoid valve (16) is disposed upstream from the connecting point of the inlet pipe (7) to the pressure equalizing pipe (15) (on the upper side in FIG. 1). The solenoid valve (16) forms a suction side non-return valve for allowing only a flow of fluid directed toward the impeller room (4).

In addition, the discharge pipe (9) is provided with a second solenoid valve (17). The second solenoid valve (17) forms a discharge side non-return valve for allowing only a flow of fluid directed from the impeller room (4) to the outside. In other words, respective solenoid valves (16, 17) are opened under operation of fluid compression to allow respective flows of fluid through the inlet pipe (7) and the discharge pipe (9).

As still another feature of the present invention, the inlet pipe (7) and the discharge pipe (9) are connected to each other through a bypass pipe (20) so as to be communicated with each other. The bypass pipe (20) is connected at one end thereof to a position of the inlet pipe (7) downstream from the first solenoid valve (16) and at the other end to a position of the discharge pipe (9) upstream from the second solenoid valve (17), thereby forming a bypass passage.

The bypass pipe (20) is provided with a bypassing solenoid valve (21) as a shut-off valve switchable between an opening state and a closing state. In the opening state of the bypassing solenoid valve (21), the bypass pipe (20) bypasses the impeller room (4) to communicate the inlet pipe (7) with the discharge pipe (9). On the other hand, in the closing state of the bypassing solenoid valve (21), communication between the inlet pipe (7) and the discharge pipe (9) through the bypass pipe (20) can be prevented.

Operation of Fluid Compression in First Embodiment

Next, description is made about an operation of fluid compression of the above-mentioned centrifugal compressor (1).

Under operation of fluid compression, the bypassing solenoid valve (21) is first closed, the first solenoid valve (16) and the second solenoid valve (17) are opened, and in this state the motor (10) is driven into rotation. The rotation of the motor (10) causes a high speed rotation of the impeller (6) in the impeller room (4).

At this time, respective gas layers are formed due to gas pressures in a clearance between the outer periphery of the lower end of the large-diameter part (11*b*) of the driving shaft (11) and the inner periphery of the through hole (12*a*) of the bearing plate (12) and in a clearance between the outer periphery of the upper end of the large-diameter part (11*b*) of the driving shaft (11) and the inner periphery of the through hole (13*a*) of the bearing plate (13), thereby forming respective dynamic pressure gas bearings (18). The gas layers radially support the driving shaft (11) to the bearing plates (12, 13) in respective non-contact states.

Further, respective gas layers are also formed due to gas pressures in a clearance between the thrust bearing plate (14) and the upper bearing plate (13) and in a clearance between the thrust bearing plate (14) and the partition wall (3) of the casing (2), thereby forming respective dynamic gas pressure bearings. The gas layers support the driving shaft (11) in a direction of thrust.

The high speed rotation of the impeller (6) in the impeller room (4) causes an axial flow of fluid into the impeller room (4) through the inlet pipe (7) and a subsequent flow of fluid into the impeller (6). The fluid then forms a radially outward flow along the vanes (6*a*, 6*a*, . . . ) of the impeller (6) and flows out of the outer peripheral end of the impeller (6). Subsequently, the fluid obtains a dynamic pressure and a static pressure under centrifugal force applied by the impeller (6) and is released to the compression space (8) by the centrifugal force. In the compression space (8), only the dynamic pressure is recovered from the fluid and the fluid is then discharged to the discharge pipe (9).

In such an operation, the inside of the inlet pipe (7) is put into a low pressure state due to a sucked reduced pressure while the inside of the discharge pipe (9) is put into a high pressure state due to the compressed fluid. The leakage fluid from the impeller room (4) to the motor room (5) returns to the inlet pipe (7) through the pressure equalizing pipe (15).

A characteristic operation of the present embodiment is performed under a deactivating operation of the centrifugal compressor (1). Under this deactivating operation, the bypassing solenoid valve (21) is opened so that the bypass pipe (20) bypasses the impeller room (4) and communicates the inlet pipe (9) with the discharge pipe (9). At the same time, both the first solenoid valve (16) and the second solenoid valve (17) are closed.

Thus, with the opening of the bypassing solenoid valve (21), a high pressure in the discharge pipe (9) acts on the inlet pipe (7) through the bypass pipe (20) so that the discharge pipe (9) and the inlet pipe (7) are equalized in pressure.

In detail, a high pressure in the discharge pipe (9) upstream from the second solenoid valve (17) acts on a part of the inlet pipe (7) downstream from the first solenoid valve (16). A fluid space between the first solenoid valve (16) and the second solenoid valve (17), i.e., the inlet pipe (7), the discharge pipe (9), the bypass pipe (20), the impeller room (4) and the compression space (8) are equalized in pressure.

As a result, it can be avoided that a pressure downstream from the impeller (6) becomes higher than that upstream from the impeller (6) when the centrifugal compressor (1) is deactivated. This prevents such a high pressure from causing a reverse rotation of the impeller (6).

Effects of the First Embodiment

As mentioned so far, in the present embodiment, a high pressure is introduced into the inlet pipe (7) through the bypass pipe (20) when the turbo compressor (1) is deactivated. This avoids a reverse rotation of the impeller (6), thereby preventing a reverse rotation of the driving shaft (11). Since the driving shaft (11) is prevented from rotating in reverse, it can be securely avoided that the bearing functions of the dynamic pressure gas bearings (18) are not displayed due to the reverse rotation of the driving shaft (11). This securely prevents the driving shaft (11) from seizing up.

Further, when the centrifugal compressor (1) is deactivated, the first solenoid valve (16) and the second solenoid valve (17) are closed together. Hence, it can be prevented that a high pressure is introduced into a part upstream from the first solenoid valve (16) or a part downstream from the second solenoid valve (17) is put into a low pressure state. Therefore, while the impeller (6) can be prevented from rotating in reverse, other units connected to the inlet pipe (7) and the discharge pipe (9) can be securely prevented from being affected.

In the present embodiment, the solenoid valves (16, 17) are provided in the inlet pipe (7) and the discharge pipe (9) respectively to allow a fluid to flow in a single direction according to their opening/closing operation. However, the solenoid valves (16, 17) may be substituted by non-return valves for allowing a flow of fluid only in a direction of flow under operation of fluid compression.

Second Embodiment

Next, description will be made about a second embodiment of the present invention. The structure of a centrifugal compressor (1) of this embodiment is substantially the same as in the first embodiment and therefore the detailed description is omitted.

Figure 3:
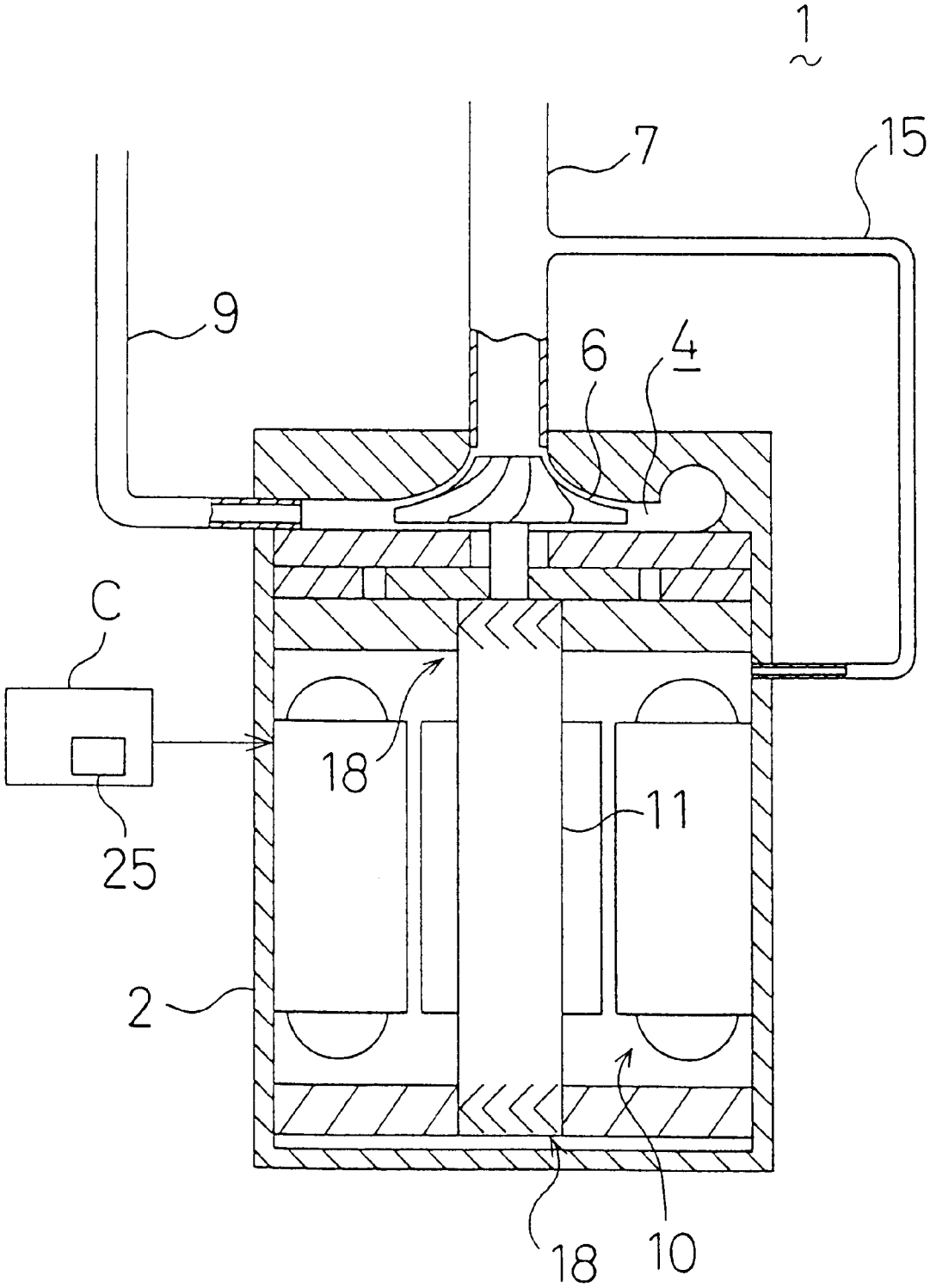
FIG. 3 is a cross-sectional view of a centrifugal compressor according to a second embodiment of the present invention.

The present embodiment is directed to avoid a reverse rotation of the compressor when the compressor is deactivated, based on an operation control of the motor (10). As a feature of the present embodiment, in addition to provision of the bypass pipe (20) and the bypassing solenoid valve (21) as in the first embodiment, the first solenoid valve (16) and the second solenoid valve (17) of the first embodiment are substituted by deactivation control means (25) provided in a controller (C) for controlling the operation of the motor (10) as shown in FIG. 3.

When the centrifugal compressor (1) is deactivated, the deactivation control means (25) gradually reduces the number of rotations of the motor (10) to a specific small number of rotations in the normal direction of rotation, holds the motor (10) at the specific small number of rotations for a set time, and thereafter brings the motor (10) into a stop.

An operation control of the motor (10) when the centrifugal compressor (1) of the present embodiment deactivated is described below with reference to FIGS. 4 and 5.

Figure 4:
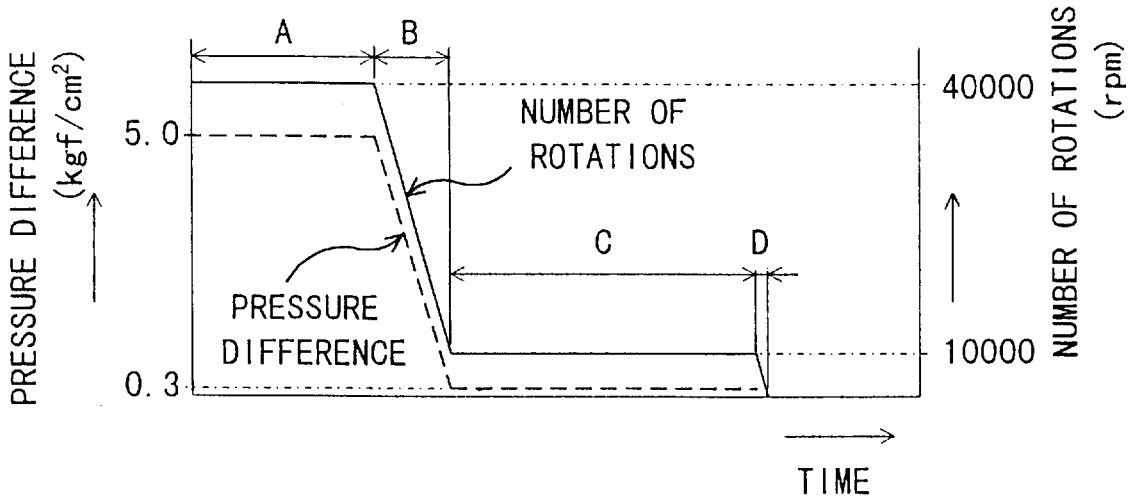
FIG. 4 is a graph about operation control of a motor according to the second embodiment.
Figure 5:
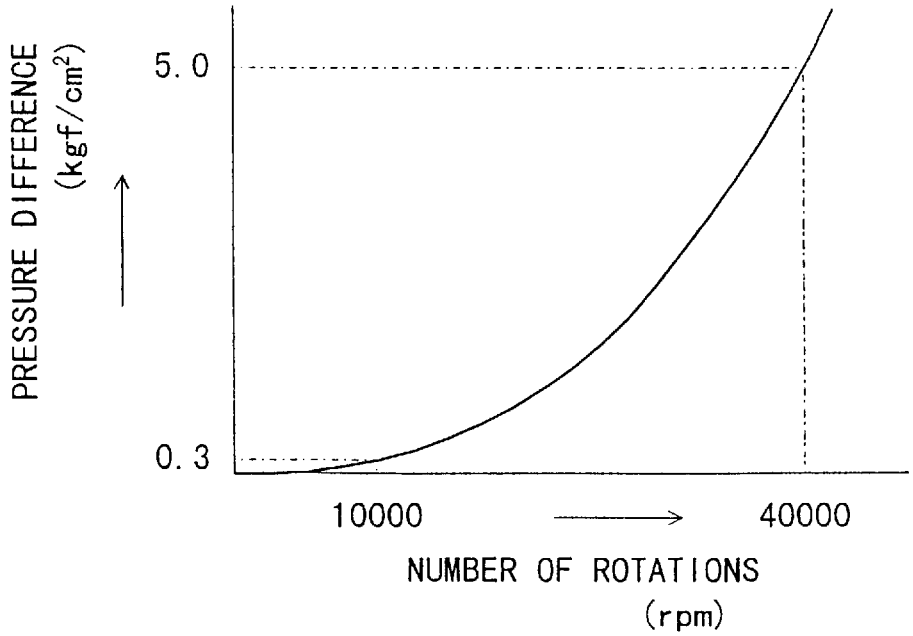
FIG. 5 is a graph showing a relationship between the number of rotations of an impeller and a pressure difference between both flows upstream and downstream from the impeller in the centrifugal compressor.
Figure 6:
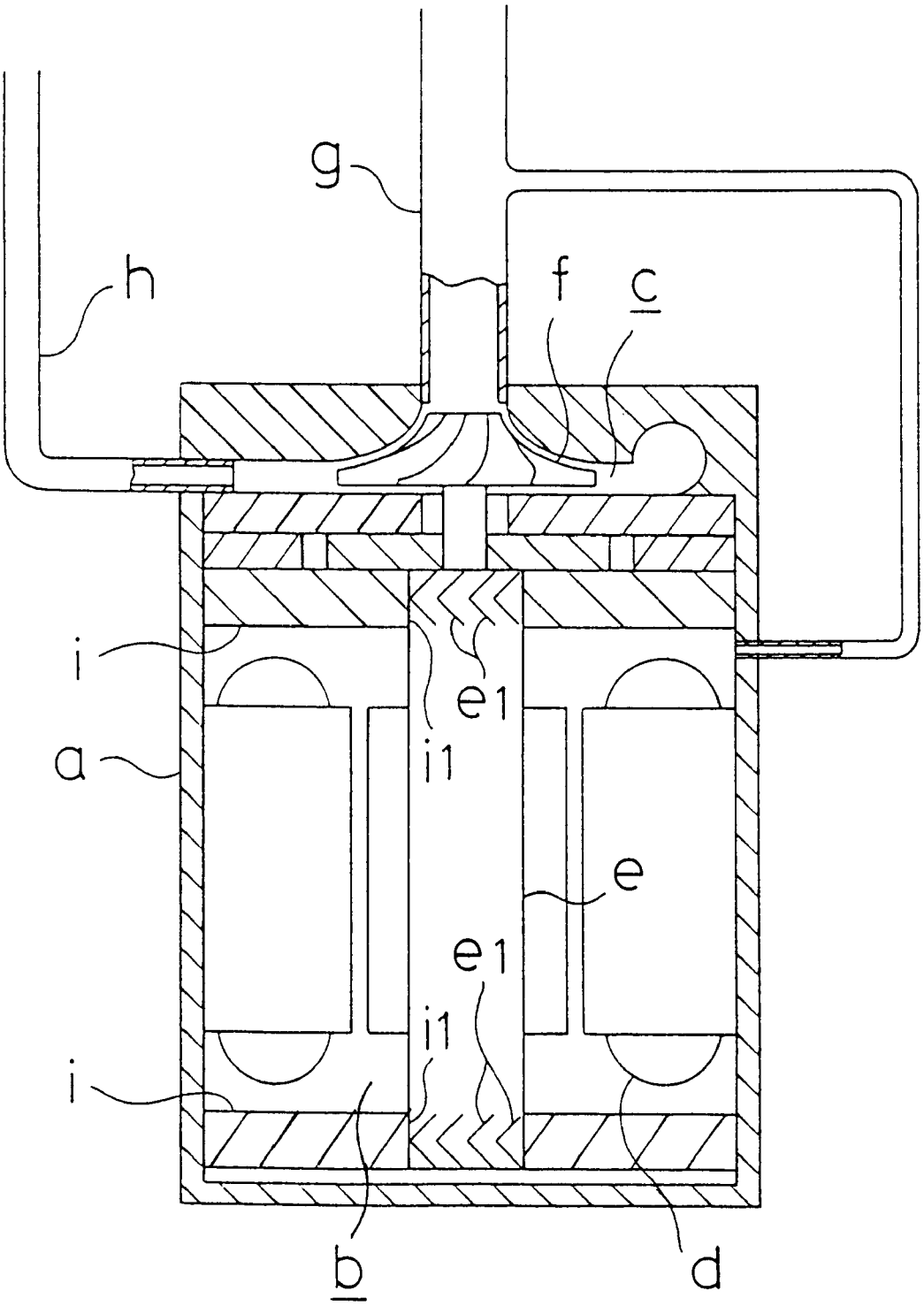
FIG. 6 PRIOR ART
FIG. 6 is a cross-sectional view showing a conventional centrifugal compressor.

The solid line of FIG. 4 indicates the number of rotations of the impeller (6) and the broken line indicates a pressure difference between the inlet pipe (7) and the discharge pipe (9).

A range "A" of FIG. 4 indicates an operating state of the centrifugal compressor (1). Under the operating state, if the number of rotations are 40000 rpm, a pressure difference between the inside of the inlet pipe (7) and the inside of the discharge pipe (9) is 5.0 kgf/cm$^2$, which is a large pressure difference.

Here, a pressure difference is described. As shown in FIG. 5, a pressure difference is substantially proportional to the second power of the number of rotations of the motor (10). Specifically, while the pressure difference is 5.0 kgf/cm$^2$ at the number of rotations of 40000 rpm in a high rotational speed range of the motor (10), the pressure difference is 0.3 kgf/cm$^2$ at the number of rotations of 10000 rpm in a low rotational speed range of the motor (10). Accordingly, in a high rotational speed range of the motor (10), the increase in pressure difference is large as compared with the increase in number of rotations. On the contrary, in a low rotational speed range of the motor (10), the increase in pressure difference is small as compared with the increase in number of rotations.

The present embodiment uses the above-mentioned characteristic of the centrifugal compressor (1). When the turbo compressor (1) is deactivated, the number of rotations of the motor (10) is first gradually reduced (See a range "B" of FIG. 4). Then, when the motor (10) reaches a specific small number of rotations, the small number of rotations is held for a set time (See a range "C" of FIG. 4). In this state, the pressure difference is substantially eliminated. More specifically, since the pressure difference is 0.3 kgf/cm$^2$ when the motor (10) reaches a small number of rotations of 10000 rpm, this low rotational speed state is held until a set time passes.

Subsequently, after the low rotational speed state, the motor (10) is brought into a stop (See a range "D" of FIG. 4). Accordingly, at the time of complete stop of the motor (10), the pressure difference between the upstream side from the impeller (6) (inside of the inlet pipe (7)) and the downstream side from the impeller (6) (inside of the discharge pipe (9)) is extremely small. This prevents the impeller (6) from rotating in reverse when the impeller (6) is brought into a stop.

Thus, according to the present embodiment, a reverse rotation of the impeller (6) can be prevented, when the centrifugal compressor (1) is deactivated, through the improvement in operation control of the motor (10) alone. This eliminates the need for changing the structure of the centrifugal compressor (1) .

Other Embodiments

Figure 7:
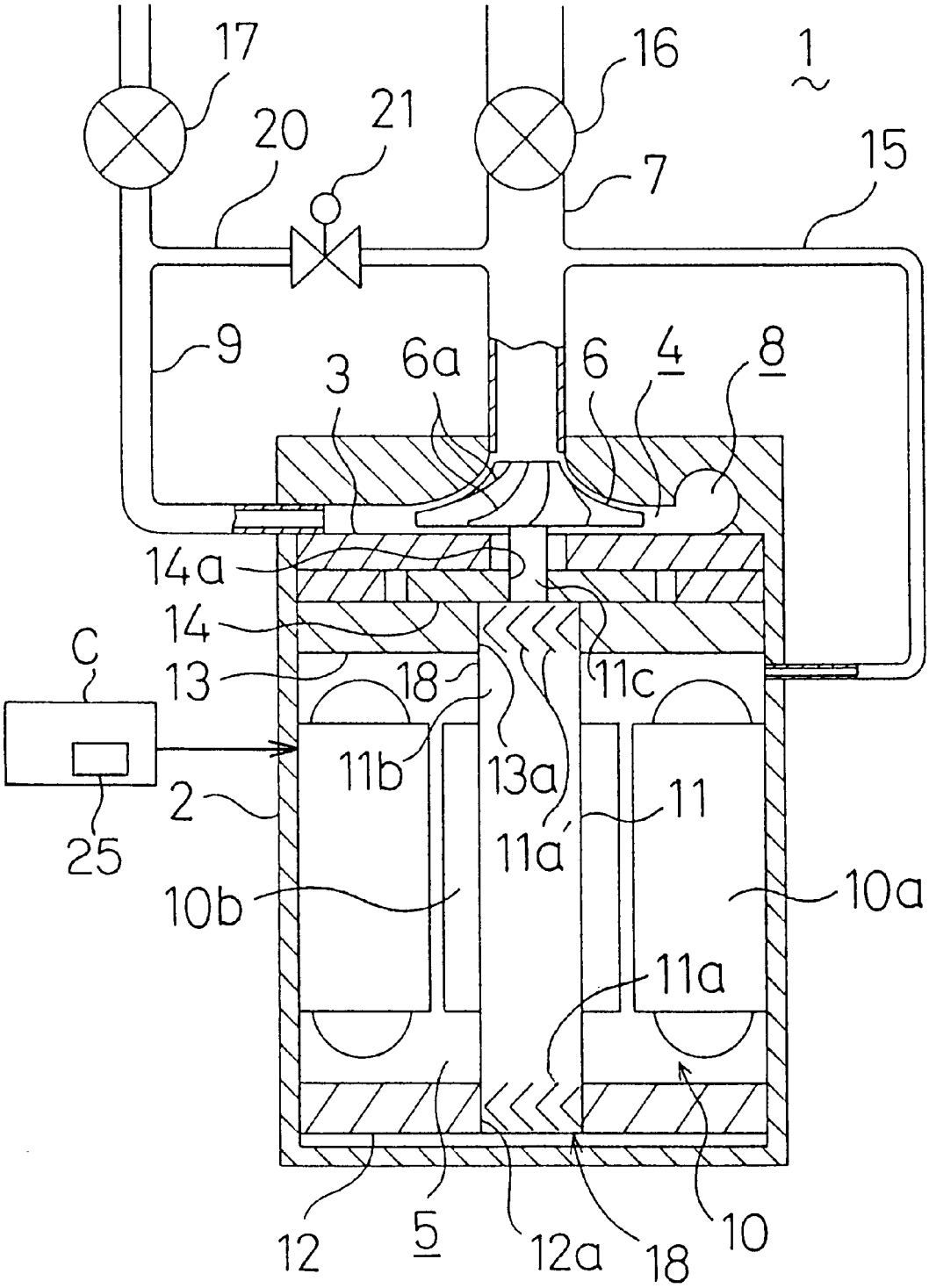
FIG. 7 is a cross-sectional view of a centrifugal compressor according to other embodiments.

In addition to the bypass pipe (20) and the bypassing solenoid valve (21), the first solenoid valve (16) and the second solenoid valve (17) are provided in the first embodiment while the deactivation control means (25) is provided in the controller (C) in the second embodiment. However, another embodiment may be designed to have both the structures of the first and second embodiments as shown in FIG. 7.

More specifically, in a deactivating motion of the motor (10), while both the first solenoid valve (16) and the second solenoid valve (17) are closed, the bypassing solenoid valve (21) is opened so that the bypass pipe (20) bypasses the impeller room (4) to communicate the inlet pipe (7) with the discharge pipe (9). Further, the motor (10) is held at a low rotational speed in the normal direction of rotation and is then brought into a stop.

As a result, the pressure difference between the inlet pipe (7) and the discharge pipe (9) can be securely eliminated at the time of stop of the impeller (6).

In detail, in the case of inverter control of the motor (10) by the controller (C), when the motor (10) is put into a low rotational speed state, a slight pressure difference remains between the inlet pipe (7) and the discharge pipe (9). In such a condition, the pressure difference can be securely eliminated by means of the bypass pipe (20). This securely prevents a reverse rotation of the impeller (6).

Further, in the case of inverter control of the motor (10), when a power failure occurs under operation of fluid compression, the function of preventing reverse rotation by the deactivation control means (25) does not work. However, since the present embodiment includes the bypass pipe (20), the bypassing solenoid valve (21) and the like, it can eliminate the pressure difference through the bypass pipe (20). Accordingly, reverse rotation of the impeller (6) can be prevented even when a power failure occurs.

In the first and second embodiments, a herringbone journal gas bearing is used as a bearing for rotatably supporting the driving shaft (11). However, such a bearing of the present invention is not limited to the above and may be a tilting pad journal gas bearing and the like.

INDUSTRIAL APPLICABILITY

As mentioned so far, an anti-reverse rotation apparatus of a compressor of the present invention is useful for super-high speed centrifugal compressor, and is particularly suitable for compressor in which a driving shaft is supported by a dynamic pressure gas bearing.

I claim:

1. An anti-reverse rotation apparatus of a compressor, the compressor having a suction passage (7) and a discharge passage (9) which are connected to a room (4) housing a rotor (6) connected to a driving shaft (11) of driving means (10), and the compressor sucking a fluid into the room (4) through the suction passage (7) by rotation of the rotor (6), compressing the sucked fluid and then discharging the compressed fluid through the discharge passage (9), the anti-reverse rotation apparatus of the compressor comprising:

a bypass passage (20) which bypasses the room (4) and connects between the suction passage (7) and the discharge passage (9);

a shut-off valve (21) provided in the bypass passage (20) for closing the bypass passage (20) under operation of fluid compression during which the rotor (6) is rotated, while opening the bypass passage (20), in a deactivating motion of the rotor (6) from a rotating state to a stopping state, to eliminate a pressure difference between the suction passage (7) and the discharge passage (9) so as to prevent reverse rotation of the rotor (6); and a dynamic pressure gas bearing (18) which produces a gas layer around the driving shaft (11) only during rotation of the driving shaft (11) in a single direction for fluid compression to rotatably support the driving shaft (11).

2. An anti-reverse rotation apparatus of the compressor according to claim 1, wherein the suction passage (7) is provided with a suction side non-return valve (16) for allowing the fluid to flow only into the room (4), the discharge passage (9) is provided with a discharge side non-return valve (17) for allowing the fluid to discharge only from the room (4), and one end of the bypass passage (20) is connected somewhere between the suction side non-return valve (16) and the room (4) in the suction passage (7) and the other end thereof is connected somewhere between the room (4) and the discharge side non-return valve (17) in the discharge passage (9).

3. An anti-reverse rotation apparatus of the compressor according to claim 1 or 2, wherein the compressor (1) is a centrifugal compressor which allows a fluid to flow in a direction perpendicular to the driving shaft (11), and the rotor is formed of an impeller (6) housed in a casing (2) for sucking the fluid from the suction passage (7) provided at the upper center of the compressor, producing a radially outward flow of the fluid and releasing the fluid outward for compression.

4. For use with a compressor in which a suction passage (7) and a discharge passage (9) are connected to a room (4) housing a rotor (6) and the rotor (6) is connected to a driving shaft (11) of driving means (10), said compressor sucking a fluid in an axial direction through the suction passage (7) by rotation of the rotor (6), producing a radially outward flow of the fluid, compressing the fluid and discharging the fluid through the discharge passage (9), an anti-reverse rotation apparatus of the compressor comprising:

a dynamic pressure gas bearing (18) which produces a gas layer around the driving shaft (11) only during rotation of the driving shaft (11) in a single direction for fluid compression thereby rotatably supporting the driving shaft (11); and deactivation control means (25) for controlling the rotor (6), prior to stop of the rotor (6) in a deactivating motion of the rotor (6) from a rotating state to a stopping state, at a specific low rotational speed near 0 in the normal direction of rotation and holding the rotor (6) at the low rotational speed until a set time passes.

5. An anti-reverse rotation apparatus of the compressor according to claim 4, further comprising:

a bypass passage (20) which bypasses the room (4) and connects between the suction passage (7) and the discharge passage (9); and a shut-off valve (21) provided in the bypass passage (20) for closing the bypass passage (20) under operation of fluid compression in which the rotor (6) is rotated, while opening the bypass passage (20), in a deactivating motion of the rotor (6) from a rotating state to a stopping state, to eliminate a pressure difference between the suction passage (7) and the discharge passage (9).

6. An anti-reverse rotation apparatus of the compressor according to claim 4 or 5, wherein the deactivation control means (25) gradually reduces the number of rotations of the rotor (6) to the specific low rotational speed near 0 in the normal direction of rotation, holds the rotor (6) at the low rotational speed until the set time passes, and thereafter brings the rotor (6) to a stop.

7. An anti-reverse rotation apparatus of the compressor according to claim 5, wherein the suction passage (7) is provided with a suction side non-return valve (16) for allowing the fluid to flow only into the room (4), the discharge passage (9) is provided with a discharge side non-return valve (17) for allowing the fluid to discharge only from the room (4), and one end of the bypass passage (20) is connected somewhere between the suction side non-return valve (16) and the room (4) in the suction passage (7) and the other end thereof is connected somewhere between the room (4) and the discharge side non-return valve (17) in the discharge passage (9).

* * * * *